United States Patent [19]

Aslund et al.

[11] 4,401,723

[45] Aug. 30, 1983

[54] CAPSULES AND PRESSINGS FOR EXTRUDING OBJECTS, PARTICULARLY TUBES, AND A PROCESS FOR PRODUCING THE CAPSULES AND PRESSINGS

[75] Inventors: Christer Åslund; Åke Åkerman; Hans Eriksson; Benny Flodin, all of Torshälla, Sweden

[73] Assignee: Granges NYBY AB, Nybybruk, Sweden

[21] Appl. No.: 88,479

[22] Filed: Oct. 26, 1979

[30] Foreign Application Priority Data

Oct. 26, 1978 [DE] Fed. Rep. of Germany ..... 2846660

[51] Int. Cl.[3] ..... B22F 3/00

[52] U.S. Cl. ..... 428/554; 428/558; 419/41; 419/42

[58] Field of Search ..... 29/420.5; 75/214, 226; 428/554, 558; 419/41, 42

[56] References Cited

U.S. PATENT DOCUMENTS

| | | | |
|---|---|---|---|
| 3,631,583 | 1/1972 | Haller | 29/420.5 |
| 3,632,243 | 1/1972 | Mott | 75/214 |
| 3,753,704 | 8/1973 | Manilla et al. | 75/214 |
| 3,803,702 | 4/1974 | Bratt | 29/420.5 |
| 4,038,738 | 8/1977 | Fischmeister et al. | 29/420.5 |
| 4,143,208 | 3/1979 | Aslund | 75/214 |

OTHER PUBLICATIONS

Popper, *Isostatic Pressing* 1976, Heyden & Son Ltd. TS245p6 pp. 33–43.

*Primary Examiner*—Brooks H. Hunt
*Attorney, Agent, or Firm*—Antonelli, Terry & Wands

[57] ABSTRACT

This invention relates to a capsule for pressings pressed by isostatic pressure and to these pressings used for extruding metallic objects, particularly tubes, of stainless steel, the outer and inner wall of the capsule consisting of thin-walled sheet metal, and at least the outer wall having substantially the same strength properties in the axial direction over its circumference and particularly consisting of a spiral-welded tube and being preferrably provided with a bulge which is directed outwardly against the shrinkage occurring during isostatic pressing, and at least on the front end of the capsule an insert being provided, which consists of one or more pieces of a ductile solid material or a ductile material pressed from powder. The invention further relates to a process for the production of such capsules and pressings and to a process for extruding tubes and to the tubes obtained according to this process.

35 Claims, 6 Drawing Figures

CAPSULES AND PRESSINGS FOR EXTRUDING OBJECTS, PARTICULARLY TUBES, AND A PROCESS FOR PRODUCING THE CAPSULES AND PRESSINGS

This invention relates to a further development of the process for the production of tubes of stainless steel described in German printed application DE-AS No. 24 19 014 and corresponding U.S. Pat. No. 4,050,143.

Said German printed application DE-AS No. 24 19 014 relates to a process for the production of tubes of stainless steel having a uniform structure, uniform physical and chemical properties and good further processing properties, in which powder-form steel of the type in question is introduced into metallic capsules; the capsules are closed and compressed by a pressure acting on all sides thereof and the pressing obtained is extruded into tubes, steel powder of predominantly spherical particles produced by sputtering or atomizing melt in an inert gas atmosphere being used and the capsules used being thin-walled capsules of a ductile metal having a maximum wall thickness corresponding to approximately 5% of the external diameter of the capsule; the density of the steel powder introduced into the capsule is increased to between about 60 and 70% of the theoretical density by vibration and/or ultrasound; the density of the steel powder is increased to at least 80% and preferably to between 80% and 92% of the theoretical density by isostatic cold pressing of the capsule under a pressure of at least 1500 bars; the pressing is heated and subsequently hot-extruded, preferably at temperatures of at least about 1200° C., to form the required semii-finished product.

According to the German printed application DE-AS No. 24 19 014 it can be of advantage to evacuate the metallic capsules filled with the steel powder before they are closed and/or to fill them with a gas, particularly an inert gas, for example argon. In addition, according to the German printed application DE-AS No. 24 19 014, it is preferred to use metallic capsules of which the wall thickness amounts to less than 3% and more particularly to less than 1% of the external diameter of the capsule, metallic capsules having a wall thickness of from about 0.1 to 5 mm and preferably from about 0.2 to 3 mm being particularly preferred.

Using the process according to said German printed application DE-AS No. 24 19 014, it is also possible to produce composite tubes using thin-walled metallic capsules which are separated by one or more concentric partitions into two or more compartments. The predominantly spherical powder particles of the various steel qualities are respectively introduced under vibration into one of these compartments, after which the partitions are removed and the capsules closed, followed by isostatic cold pressing and extrusion at elevated temperature. For extruding the pressings into tubes, glass is normally used as the lubricant. Since stringent demands are imposed on the lubricant in the extrusion of, in particular, stainless steels at elevated temperatures, the pressing is required to have a substantially flat end face so that the lubricant applied to the end face of the pressing in the form of a glass disc is effectively utilised.

It has now been found that extrusion is accompanied by the development of surface faults in the front part of the extruded product on account of the fact that the flow pattern in the transition between the cover and the jacket is seriously disturbed through the disturbing effect of welding. This causes significant losses in the yield of end product.

The object of the present invention is to increase the yield, i.e. to reduce the percentage of deffective products after extrusion.

According to the invention, this object is achieved in that at least the outer wall of the capsule is provided with a bulge which is directed outwards and against the shrinkage occurring during isostatic pressing and of which the dimensions are such that it is substantially eliminated again by the shrinkage effect.

The construction of the capsule according to the invention affords the advantage that, after the cold isostatic pressing of the capsule, the pressing is not in the form of a "sand glass" with a central constriction. In many cases, this so-called "sand glass" form arises out of the fact that the ends of the capsule, which are closed by covers or the like, undergo less shrinkage during cold isostatic pressing than the central part of the capsule. Since a pressing having a substantially cylindrically outer wall is required for extrusion, the ends of the pressing have to be trimmed where it is in the form of a "sand glass", which is not only a very expensive operation, but also involves the danger of cracks being formed. The construction of the capsule according to the invention affords the advantage that there is no longer any need for the pressing to be trimmed to make it cylindrical. In addition, it is possible by the invention to obtain pressings of which the diameters exactly correspond to the required diameters. According to the invention, it is possible to obtain accuracies of ±0.2% and, more particularly, of ±0.1%. In other words, the pressings can be produced with absolute diameteres accurate to ±0.2 mm and more particularly to ±0.1 mm.

The outer wall and/or inner wall of the capsule according to the invention are preferably produced in the form of substantially cylindrical sections at the ends of the capsule, the diameters of which exactly correspond to those of the required pressing and which steadily merge into a bulged, central region of the capsule.

According to the invention, the outer and/or inner wall of the capsule is/are advantageously shaped in such a way that, from each of the cylindrical sections at the ends of the capsule, the bulge gradually and steadily increases in the axial direction (looking towards the middle of the capsule) initially in a region having an outwardly concave cross section, the inclination of the outer and/or inner wall relatively to the axis of the capsule also gradually and steadily increasing, followed preferably by a conical intermediate region in which the inclination of the outer and/or inner wall remains substantially constant, this conical intermediate region being followed by a region in which the outer and/or inner wall has an outwardly convex cross-section and gradually and steadily merges into an axially parallel central section which preferably has a substantially constant diameter.

According to the invention, it is also possible to improve the dimensional accuracy of the pressing and to reduce the number of rejects by arranging a plate-shaped, conical, hemispherical or funnel-shaped insert of solid material at the front and/or rear end of the capsule. The provision of inserts such as these considerably improves the flow properties during extrusion of the pressing and increases the yield of stainless material because the inserts, which preferably consist of an electrically conducted material, preferably soft iron or a low carbon soft steel, form the ends of the extruded tubes which have to be cut off in any case. In addition, the presence of the inserts preferably consisting of an electrically conducted metal at the front and/or rear end of the capsule makes the pressing much easier to heat by induction before extrusion because the metallic inserts may readily be treated by induction and give off their heat to the remaining parts of the pressing, particularly to the powder-filled interior thereof, thus contributing towards the rapid heating of the pressing as a whole.

It has proved to be of particular advantage to combine the provision of the above-mentioned inserts at the front and/or rear end of the capsule with the provision in the outer and/or inner wall of the capsule of a bulge which is directed outwards and against the shrinkage occurring during isostatic pressing and of which the dimensions are such that it is substantially eliminated again by the shrinkage effect. According to the invention, this combination enables the dimensions of the pressing to be kept considerably more accurate. In particular, it is possible to keep the dimensions of the pressing accurate to ±0.05% or, in absolute terms, accurate to ±0.1 mm or more, which is of considerable importance for the fault-free production of extruded articles, particularly extruded tubes.

According to the invention, the inserts may be in the form of covers which close the capsule at its ends and may be tightly welded to the outer and inner walls of the capsule. Sheet metal inserts in the form of covers may with advantage also be provided between the inserts and the interior of the capsules and may be tightly welded to the outer and inner walls.

According to the invention, it is possible in the case of capsules for the production of pressings for extruding tubes to use funnel-shaped, centrally bored inserts for the front end face of the capsules, the angle $\beta$ between the wall of the central bore for the inner wall of the capsule and the conical outer surface of the funnel-shaped insert amounting to between about 40° and 60°, preferably to between about 40° and 50° and, more particularly, to about 45°.

According to the invention, it can be of advantage in the production of tubes to provide at least on the front end of the capsule a centrally bored annular insert which has a substantially flat end surface and of which the boundary surface between the wall of the central bore and its largest diameter has a substantially arcuate cross-sectional profile, the centre of the arcuate profile lying substantially in the vicinity of the intersecting line between the flat end face and the central bore.

According to the invention, another significant improvement in the capsules and the pressings and extruded articles, particularly extruded tubes, produced from them, may be obtained in combination with or independently of the above-described inserts constructed in accordance with the invention by ensuring that at least the outer wall of the capsule has substantially the same strength properties in the axial direction over its entire circumference. According to the invention, at least the outer wall of the capsule is preferably formed by a thin-walled, spiral-welded or extruded tube. Forming the outer wall of the capsule in this way affords the advantage that extruded products, particularly tubes, characterised by a considerably reduced number of faults and, hence, rejects are obtained.

The pitch of the spiral formed by the weld seam in relation to the length of the capsule is preferably such that the weld seam approximately forms one complete turn. An outer wall provided with a weld seam such as this has only one weld seam at any point along its circumference in the axial direction and, therefore, shows substantially the same strength properties in the axial direction. Alternatively, the weld seam may form two, three or more complete turns.

The present invention in applicable to capsules and pressings for extruding objects, particularly tubes, bars or similarly profiled, elongate, dense metallic objects, particularly of stainless steel or highly alloyed nickel steels, particularly heat-resistant steels for heat exchangers, for example highly alloyed nickel steels containing approximately 80% of nickel and 20% of chromium, powder of metal or metal alloys or mixtures thereof or mixtures of powders of metals and/or metal alloys with ceramic powders being introduced into the capsule according to the invention. The powder used is preferably spherical or predominantly spherical powder having a mean particle diameter of preferably less than 1 mm. According to the invention, it is preferred to use spherical powder which has been produced from the required starting material, i.e. the required metal and/or metal alloy, by sputtering in an inert gas atmosphere, preferably an argon atmosphere. Powder particles larger than 1 mm in diameter are preferably separated out, at least to a predominant extent, because argon is in danger of being included into powder particles larger than 1 mm in diameter. An inclusion or argon such as this can occur during sputtering, for example through turbulence. Any inclusion of argon would give rise during extrusion to unfavourable properties of the extruded articles and would lead to inclusion lines.

According to the invention, the capsule used for producing the pressings for the tubes to be extruded is filled with the powder, the density of the powder introduced into the capsule being increased by vibration to between about 60 and 71% of the theoretical density and the frequency of the vibration preferably amounting to at least about 70 Hz and advantageously to between 80 and 100 Hz. By vibration at a frequency of from 80 to 100 Hz, it is possible to obtain a density of from about 68 to 71% of the theoretical density.

After the powder has been introduced and compacted by vibration, the capsule is closed, preferably after evacuation and/or filling with an inert gas. Thereafter the density of the powder is increased to at least 80 to 93% of the theoretical density of isostatic cold pressing under a pressure of at least 4000 bars, preferably under a pressure of from 4200 to 6000 bars and, more particularly, under a pressure of from 4500 to 5000 bars.

Capsules of thin sheet steel, preferably about 1 to 2 mm thick sheet steel and, more particularly, approximately 1.5 mm thick sheet steel, have prooved to particularly advantageous. The material used for these capsules is preferably low-carbon soft steel, particularly steel having a carbon content of less than 0.015% and, better still, less than 0.004% in order to prevent the powder from carburising during heating and extrusion.

Under the effect of the pressure applied on all sides during cold isostatic pressing, the capsule is uniformly compressed both in the longitudinal and in the radial direction and thus forms a pressing. This pressing should have no irregularities because this would give rise to difficulties during extrusion, particularly during the extrusion of tubes.

In order to produce a pressing for extruding a tube, an annular capsule is used, the outer wall of this annular capsule being formed by a spiral-welded tube section produced for example from an approximately 1.5 mm thick sheet.

An inner wall, for example in the form of a longitudinally welded tube section, is introduced into the interior of the outer wall, having a smaller diameter than but the same well thickness as the outer wall. An annular cover is then fixed between the outer wall and the inner wall at one end and the annular space between the two tubes is thus closed at one end. Spherical powder is then introduced into the annular space and compacted to around 68% of the theoretical density by vibration at a frequency of, for example, 80 Hz. A vacuum is then applied and the other end of the annular body is sealed off by a corresponding second cover. This is followed by cold isostatic pressing in a liquid, for example water, under a pressure of, for example, 4700 bars. Under the effect of the pressure applied on all sides, a pressing having a density of, for example, 85% of the theoretical density is obtained.

In the capsule according to the invention, the spiral weld seam is required to be as smooth as possible with as little effect as possible on the properties of the sheet steel. Accordingly, the weld seam is preferably smoothed by rolling and/or grinding. The smoothing of the weld seam by rolling may be carried out immediately after welding.

In the case of capsules for the production of tubes, it can be of advantage to produce not only the outer wall, but also the inner wall from a tube which has substantially the same strength properties in the axial direction along its circumference. In this case, the inner wall may consist either of a spiral-welded tube or of an extruded tube. The use of an extruded or spiral-welded tube for the inner wall is particularly advisable in the production of large tubes. In the production of smaller tubes, it is generally sufficient in accordance with the invention for the outer wall of the capsule to be produced from a tube section which has substantially the same strength properties in the axial direction along its circumference.

An embodiment of the invention is described by way of example in the following with reference to the accompanying diagrammatic drawings, wherein.

Figure 1:
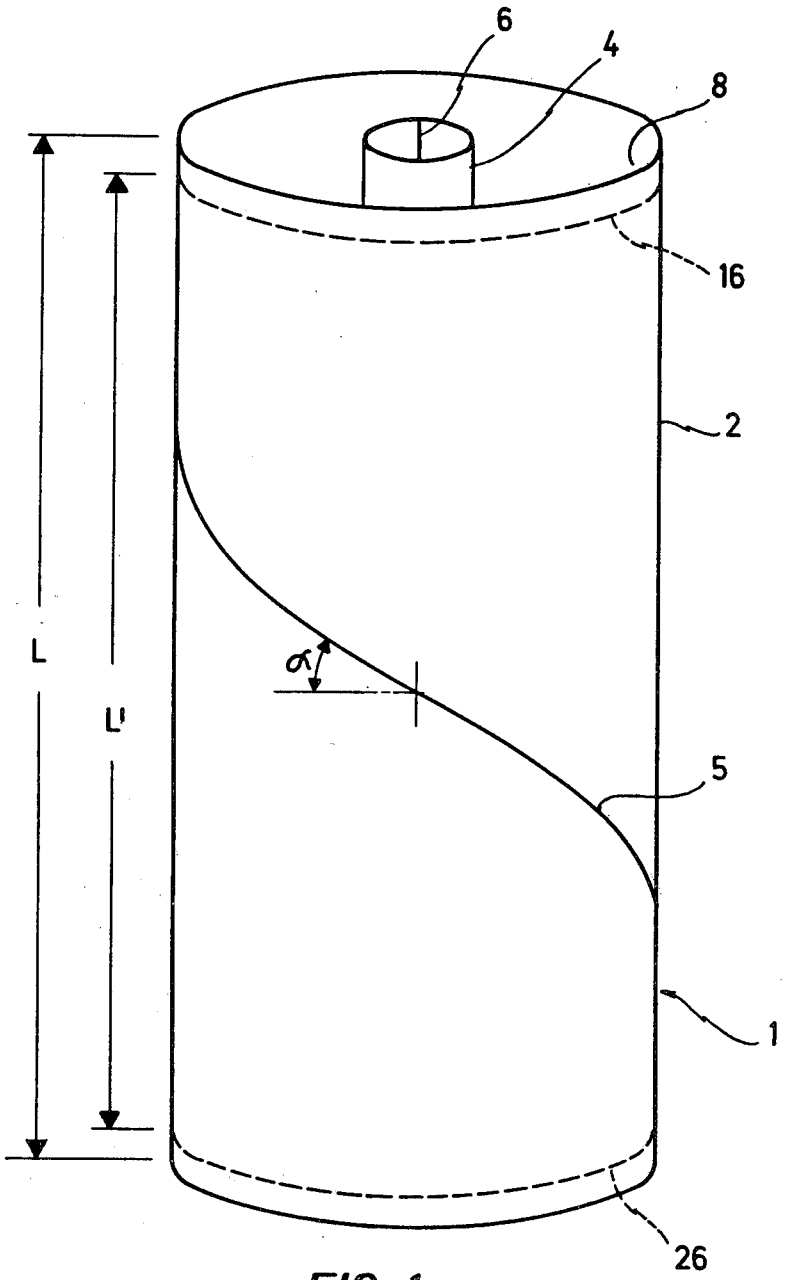
FIG. 1 is an elevation of a capsule open at its upper end.

In FIG. 1, the capsule is generally denoted by the reference 1. The capsule has an outer wall 2 and inner wall 4. The outer wall 2 consists of a spiral-welded tube section having a length L. The weld seam 5 extends spirally over the circumference of the outer wall 2, the spiral having a helix angle $\alpha$ such that the spiral forms approximately one complete turn.

It has been found to be of advantage to arrange the weld seam 5 in such a way that it forms one complete turn between the weld seam 16, which is used to weld the cover (not shown in FIG. 1) of the capsule firmly to the outer wall 2, and the weld seam 26 by means of which the base of the capsule is joined to the outer wall. The distance between the weld seams 16 and 26 is denoted by the reference L' in FIG. 1. This length L' may be regarded as the effective length of the capsule. It is advisable to select the helix angle $\alpha$ of the spiral weld in such a way that $$tg\,\alpha = \frac{L'}{n \cdot \pi \cdot D}$$

where D is the diameter of the capsule and n the number of turns which the spiral weld seam 5 is required to comprise. It has been found to be advisable for n to have a value of 1. However, it may also be of advantage for n to have a value of 2,3,4 or to be equal to a larger whole number.

In one practical example, the outer wall 2 and also the inner wall 4 of the capsule 1 consisted of 1.5 mm thick soft sheet steel having a carbon content of less than 0.004%. The cover, which is not shown in FIG. 1, was welded in along the weld seam 16. To produce the pressing, powder which consisted predominantly of spherical particles having a mean diameter of less than 1 mm and which had been produced from the required starting material, for example stainless steel, by sputtering in an argon atmosphere, was introduced into the capsule. After it had been introduced into the capsule, the powder was compacted to a density of, for example, approximately 68% of the theoretical density by vibration at a frequency of, for example, 80 Hz. The capsule was then evacuated and closed by means of a cover. The cover was directly joined to the outer wall 2 of the capsule by welding substantially along the line 16 in FIG. 1. In the example in question, the capsule had a length of 600 mm and an external diameter of 150 mm. The internal diameter of the inner wall 4 was approximately 55 mm. The inner wall 4 consisted of a longitudinally welded tube section with a longitudinal weld seam 6. The powder was then compressed for example to around 88% of the theoretical density by cold isostatic pressing under a pressure of, for example, 4700 bars. The pressing thus obtained was extruded into a tube as described in said German printed application DE-AS No. 24 19 014.

Figure 2:
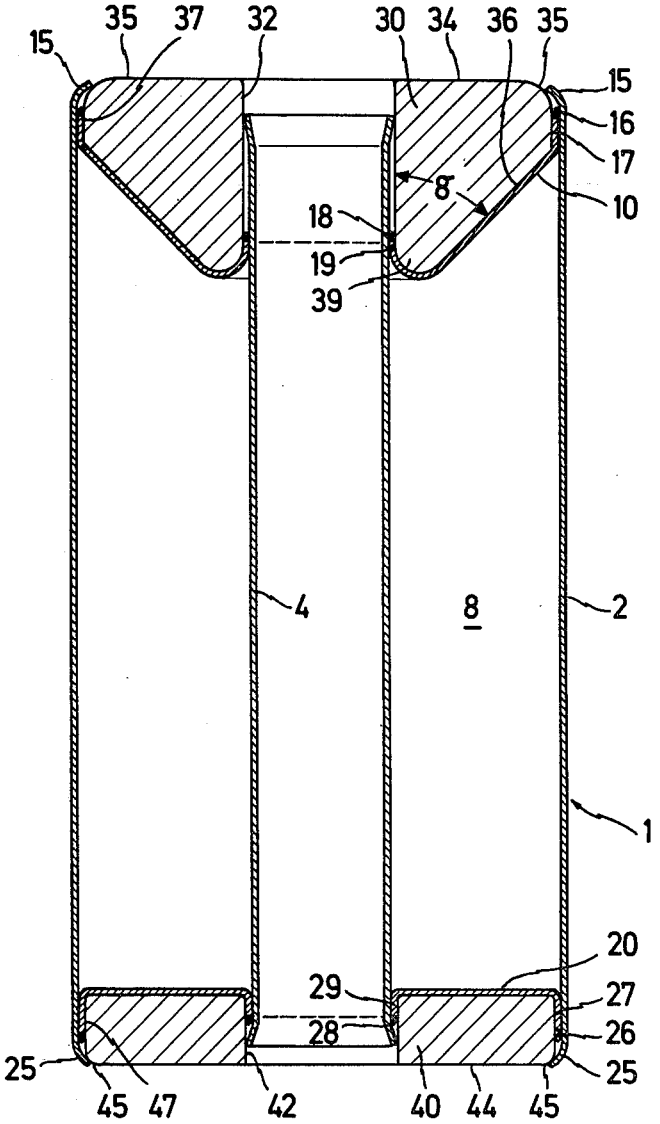
FIG. 2 is a longitudinal section through a modified embodiment of the capsule.

In the embodiment illustrated in FIG. 2 inserts 30 and 40 are arranged in the region of the cover 10 and the base 20, forming the front and rear end face, respectively, of the capsule. The front insert 30 is generally conical and comprises a central bore 32 for receiving the inner wall 4 of the capsule. The conical surface 36 of the conical or funnel-shaped insert 30 forms with the wall of the bore 32 an angle $\beta$ which is preferably in the range from about 40° to 60°, advantageously in the range from about 40° to about 50° and, more particularly, of the order of 45°. The insert 30 comprises a substantially flat end face 34. However, it is bevelled or rounded off at its outer edge (at 35) and then comprises a cylindrical section 37 which merges into the conical surface 36. The transition from the conical surface 36 to the wall of the central bore 32 is rounded off at 39. The cover 10 in the form of a sheet-metal insert corresponds exactly in its contour to the adjoining parts of the insert 30. More particularly, the cover 10 comprises along its outer edge a cylindrical section 17 which provides for firm contact between the cover 10 and the outer wall 2, the outer edge of this cylindrical section 17 being joined to the outer wall 2 by means of a weld seam 16. In its inner region, too, the cover 10 comprises a short, substantially cylindrical section 19 which is in contact with the inner wall 4 of the capsule and which is tightly welded to the inner wall 4 at 18 by means of a weld seam. The cover 10 also comprises a rounding-off corresponding to the rounding-off 39 of the insert 30.

Arranged at the rear end of the capsule 1 is an insert 40 in the form of a substantially flat plate which comprises a central bore 42 and an outwardly directed end face 44. This plate-like insert 40 is also bevelled or rounded off at its edge (at 45) and comprises an outer cylindrical section 47. The base 20 of the capsule corresponds in shape to the shape of the insert 40 and also comprises an outer cylindrical section 27 and an inner cylindrical section 29. The base 20 is tightly welded to the outer wall 2 and the inner wall 4 by means of weld seams 26 and 28, respectively. The inserts 30 and 40 preferably consist of soft iron or low carbon soft steel.

Figure 3:
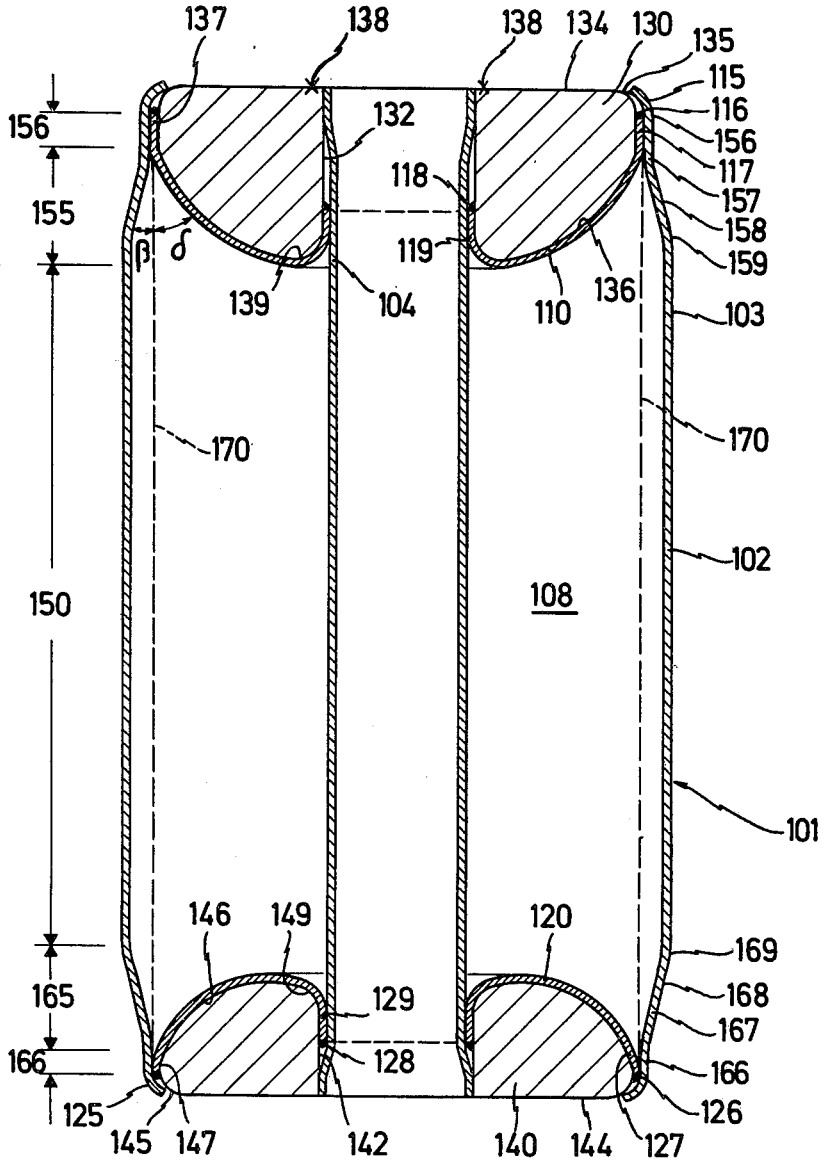
FIGS. 3 to 6 are partial sections through other embodiments.

FIG. 3 shows a modified embodiment of the capsule in which an insert 130 provided at the front end of the capsule comprises a substantially arcuate cross-sectional profile 136, a flat end face 134 and a central bore 132. The centre of the arcuate cross-sectional profile 136 are situated on a circle substantially in the vicinity of the intersecting line between the flat end face 134 and the wall of the bore 132, i.e. in the region of the front boundary line of the bore 132. This circle is indicated by two crosses at 138 in FIG. 3. The substantially arcuate cross-sectional profile 136 affords the advantage that, during extrusion of the pressing, the insert 130 consisting of soft iron or a similar metal, together with the cover 110, the weld seams 116, 118 and the adjacent parts of the outer wall 102 and the inner wall 104, forms the first part of the tube which is cut off or even drops off automatically after extrusion if the connection to the following tube preferably consisting of stainless steel and produced from the powder filling of the capsule lacks sufficient strength. The effect of the substantially arcuate shape of the boundary line 136 of the insert 130 is that the dividing line between the front part of the extruded tube, which accumulates as waste, and the actual tube consisting of high quality stainless steel is clearly defined and is in the form of a separation surface extending substantially perpendicularly of the longitudinal axis of the tube. The cover 110 also comprises a substantially cylindrical section 117 which is welded at 116 to the outer wall 102 of the capsule, and a substantially cylindrical inner section 119 which is in contact with the inner wall 104 and which is tightly welded to the inner wall at 118 by means of an encircling weld seam. The transition from the wall of the central bore 132 to the circular cross-sectional profile 136 is rounded off at 139.

It can also be of advantage for the inserts 30 and 40 to be directly welded to the outer wall 2 and the inner wall 4. In this case, the cover 10 and the base 20 may be omitted. Similarly, the insert shown in FIG. 3 may be directly welded to the outer wall 102 and to the inner wall 104.

In cases where sheet-metal inserts are used as cover and base, it may be of advantage to join the inserts 30, 40 and 130, 140 to them by spot welding. In many cases, however, it is also sufficient to fix the inserts 30, 40 and 130 140 through the flanged ends 15, 25 and 115 125 of the outer wall 2 and 102.

During extrusion, the insert at the front end of the capsule leads to a type of tunnel effect providing it is made of a ductile material, for example ductile iron, soft iron, low-alloyed carbon steel or cast iron. The pressure required in the container of the extrusion press for extruding the pressing is reduced where the front insert consists of ductile material which can be made to flow more easily than the powder filllng of the pressing. Once the flow process taking place during extrusion has started, it also affects the powder filling, even when the yield point of the powder filling is higher than the yield point of the ductile material of the insert. Accordingly, a type of tunnel effect is obtained.

In FIG. 3, the outer wall 102 comprises a bulge 103 which is directed against the shrinkage occurring during cold isostatic pressing. In FIG. 3, the insert 140 also has a substantially arcuate cross-section 146 at the base 129 of the capsule. In the region of the central bore 142, this substantially arcuate cross-section merges into the wall of the bore 142 via a rounded region 149. Externally the insert 140 has a substantially cylindrical section 147 with which a cylindrical section 127 of the base 120 comes into contact. The cylindrical section 127 is welded at 126 to a substantially cylindrical section 166 of the outer wall 102. The cover 120 rests on the inner wall 104 at its cylindrical section 129 and is welded to the inner wall at 128. The outer end 144 of the insert 140 is flat, being rounded off or bevelled at its outer edge at 145 so that the flanged lower edge 125 of the ouer wall 102 is able firmly to hold the insert 140. The dimensions of the bulge 103 are such that, after cold isostatic pressing, the inner surface of the outer wall 102 contracts up to the line 170 which corresponds to the ideal cylindrical form. Accordingly, the cylindrical sections 156 and 166 of the outer wall 102 are also drawn in, preferably by rolling, until they are in alignment with the line 170.

In order to prevent crease formation and to obtain an accurately centered pressing, it is of advantage in accordance with the invention to confine the change in diameter of the outer wall 102 substantially to the region of the inserts 130 and 140. Between these inserts, the outer wall 102 has a substantially constant external diameter in the region shown at 150. It has proved to be of particular advantage for the cylindrical sections 156, 166 to be adjoined towards the middle of the capsule by regions 156 and 167 having an outwardly concave cross-section and for these regions to be followed by frustoconical intermediate regions 158 and 168 which are in turn followed by regions 159, 169 which have an outwardly convex cross-section and merge into the cylindrical, axially parallel central region 150. It is essential for the outwardly concave regions 157 and 167 to be virtual mirror images of the cross-sectional profiles 136 and 146 of the inserts, the line 170 representing the mirror symmetry axis and the angle of curvature of the outer wall indicated at $\beta$ being reduced substantially commensurately with the percentage shrinkage to the angle of curvature of the adjacent insert.

Figure 4:
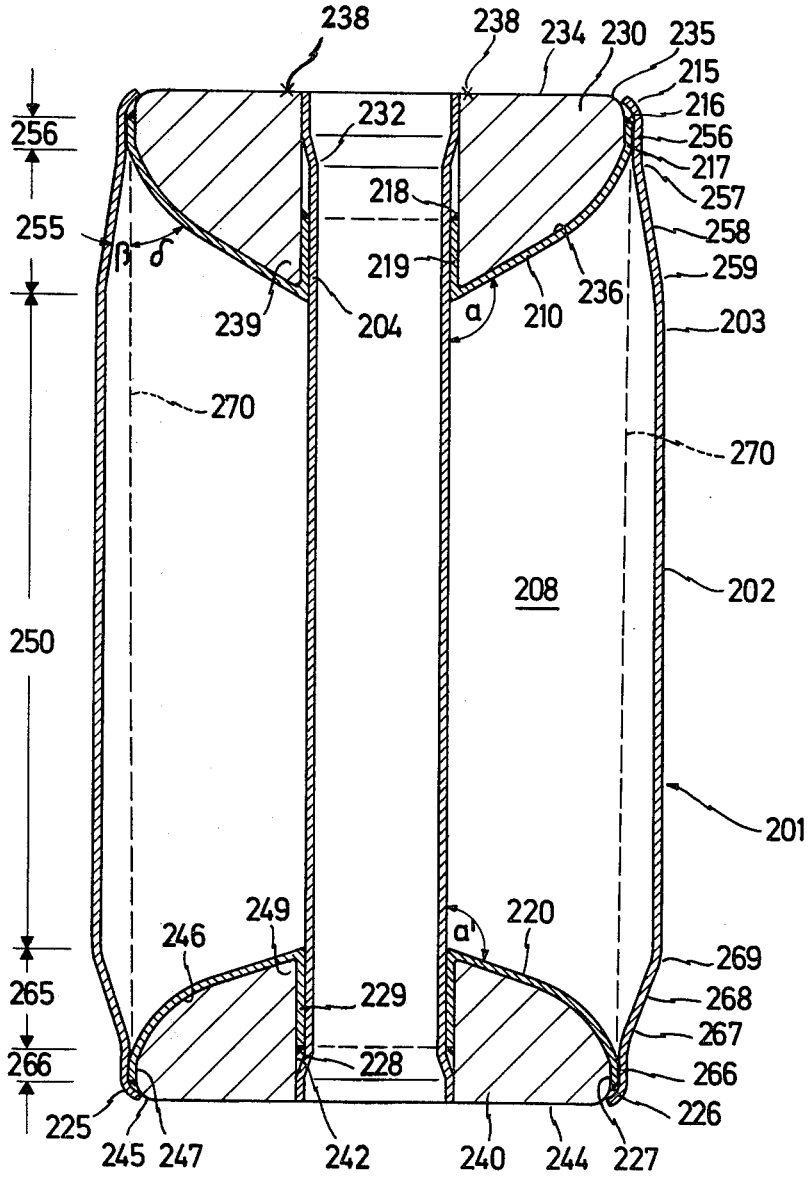

FIG. 4 shows a modified embodiment similar to FIG. 3 in which all identical or similar components are denoted by reference numerals increased by 100. The main difference lies in the fact that the inserts 230 and 240 have a substantially pointed cross-sectional profile at 239 and 249, respectively, so that the correspondingly shaped cover 210 and the correspondingly shaped base 200 extend right up to the inner wall 204 and form obtuse angles a and a' therewith. It has been found that this configuration is advantageous for exactly centering the pressing. In the embodiment shown in FIG. 4, the inner wall 204 does not have to be provided with a bulge whereas, in the embodiment shown in FIG. 3, it can be of advantage to provide the inner wall with a slight outwardly directed bulge. According to the invention, it can be of advantage to provide the outer and/or inner wall with a bulge in conjunction with inserts of any shape. It can also be of advantage to combine the bulge with a spirally welded outer and/or inner tube.

Figure 5:
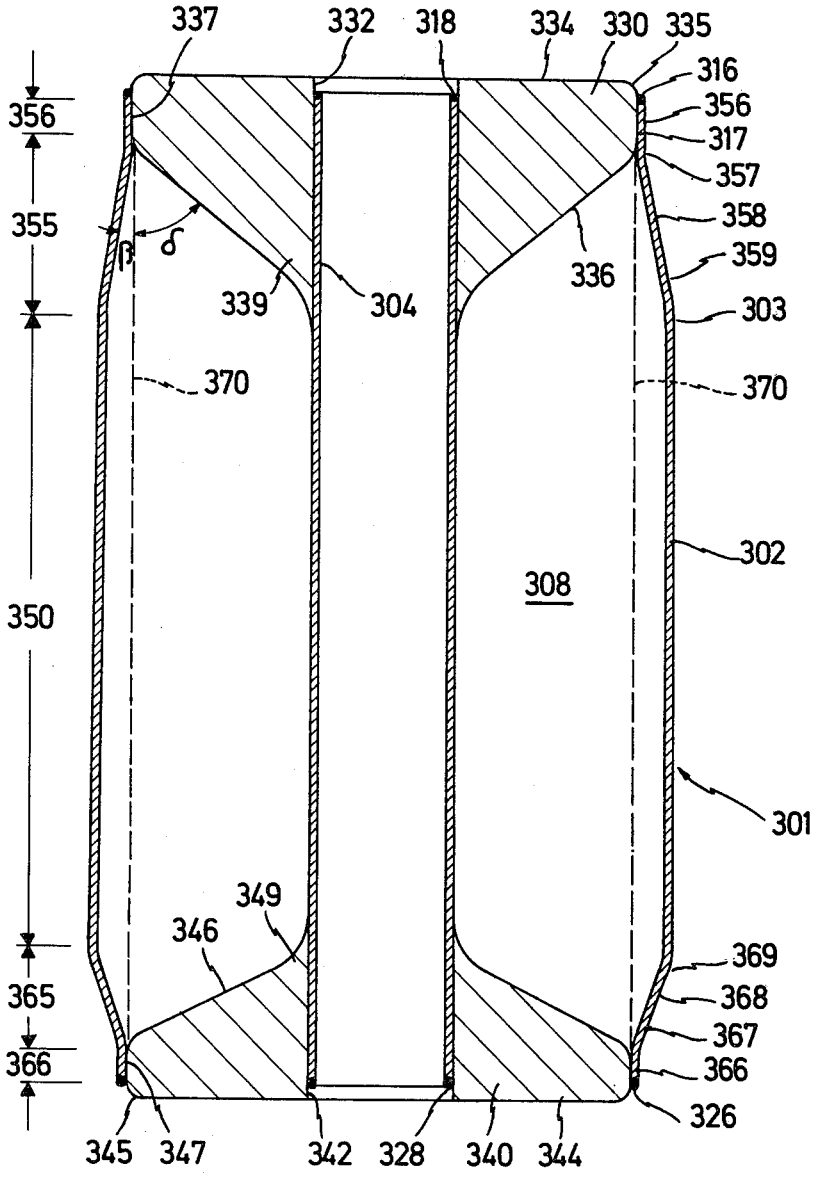

FIG. 5 shows a modified embodiment similiar to FIG. 4 in which all identical or similar components are denoted by reference numerals increased by 100. The main difference lies in the fact that the insert 330 and 340 are provided with points 339 and 349 and that no sheet metal liners are provided. From each of the cylindrical sections 356, 366, the bulge 303 increases gradually and steadily in the axial direction, looking towards the middle of the capsule, initially in a region 357, 367 having a concave cross-section, the inclination of the outer wall 302 relatively to the axis of the capsule also increasing gradually and steadily. Thereafter, the inclination of the outer wall 302 remains substantially constant via a conical intermediate region 358, 368, followed by a region 359, 369 in which the outer wall 302 has an outwardly convex cross-sectional profile and merges gradually and steadily into an axially parallel central region 350. Those regions of the outer wall 302 which have a changing cross-section each form a transitional region 355, 365 which is situated in the region of an insert 330 or 340. The cross-section 336, 346 of the insert 330, 340 is a virtual mirror image of the contour of the outer wall in the transitional regions 355, 365, which is reflected at the line 370 of the required cylindrical form of the pressing, but extended in the radial direction, the degree of extension substantially corresponding to the ratio of the difference between the external and internal diameters of the pressing to the reduction in diameter of the capsule, preferably taking into account the change in the cross-sectional area with decreasing radius.

The insert 330 and 340 are tightly welded to the outer and inner walls at 316, 318, 326 and 328. 337 and 347 are cylindrical sections of the inserts 330 and 340 which correspond to the cylindrical sections 137, 147 and 237, 247 of FIGS. 3 and 4.

EXAMPLE

To produce a pressing having an external diameter of 144 mm for extruding a tube of stainless steel having an external diameter of 50 mm and a wall thickness of 5 mm, a spirally welded 600 mm long tube having an external diameter of 154 mm and wall thickness of 1.5 mm, used as the outer wall for the capsule, was necked at its two ends by rolling or pinching in such a way that cylindrical sections having an external diameter of 144 mm, corresponding to the sections 156, 166; 256,266; 356, 366 in FIGS. 3 to 4, were present at the ends, being adjoined by transitional regions formed in accordance with the transitional regions 155, 165; 255, 265; 355, 365. The ends of the outer wall were then ground flat. At a first end, a sheet metal insert forming a base, similar to the insert 120 in FIG. 3, was tightly welded on the one hand to the outer wall and, on the other hand, to an inner wall which consisted of a 590 mm long longitudinally welded tube having a wall thickness of 1.5 mm and an internal diameter of 40 mm.

An annular or funnel-shaped insert similar to the insert 140 consisting of low-alloyed carbon steel containing approximately 0.004% of carbon was then inserted from the above-mentioned front end of the outer wall up to the base sheet to which it was fixed by spot welding. The capsule was placed vertically on a plate, filled with powder, vibrated at 80 Hz, compacted to around 68% of the theoretical density and, at the same time, provided with a funnel-shaped sheet-metal insert similar to 110 in FIG. 3 acting as cover which was inserted under high pressure from above between the inner and outer walls. The sheet metal insert was then tightly welded to the inner and outer walls, as shown at 116 and 118 in FIG. 3. The front annular or funnel-shaped insert similar to 130 in FIG. 3 and consisting of low-alloyed carbon steel containing approximately 0.004% of carbon was then inserted from above. This annular insert was advantageously spot-welded to the funnel-shaped sheet metal insert or to the inner or outer wall.

The capsule was the subjected to cold isostatic pressing (4700 bars) in water to a density of 88% of the theoretical density. The pressing contracted to an external diameter of 144 mm, i.e. to the same diameter as the drawn-in cylindrical sections at its ends. The diameter of 144 mm also corresponded to the internal diameter of the container of the extrusion press. Perfect centering was thus guaranteed. In addition, the internal diameter of the pressing was almost exactly 40 mm. Moreover, the pressing was also completely straight and, after inductive heating to 1200° C., could be directly extruded to form the required stainless and seamless tube without any need for further machining operations. The front section of the tube consisting of low-alloyed carbon steel was cut off. None of the stainless was cut off. By virtue of the fact that the insert is concical, a substantially vertical (relative to the tube axis) parting line between the extruded insert and the stainless steel was obtained in the extruded tube. That part of the tube which consisted of stainless material had a fault-free surface. In this way, the loss of material was reduced to a minimum.

All the particulars and features disclosed in the documents, particularly the spatial configuration disclosed, are claimed as being essential to the invention where they are new either individually or in combination in relation to the prior art.

In order to obtain good separation between the front section of the extruded tube, which consists of a low alloy carbon steel, and the desired seamless tube of stainless steel, a layer of glass can according to the invention be applied to the front insert at the surface facing the powder filling 308. It can be suitable for this purpose to heat the front insert member 330 and to sprinkle glass powder onto the surface 336, the temperature of the insert member 330 being selected so that the glass powder becomes soft and adheres. By such an intermediate layer of glass, the separation between the low alloy carbon steel and the stainless steel is made very much easier when the extruded tube is obtained so that the two steel grades are obtained completely separately from each other and without mixing. Analogously, also the surface, which is adjacent to the powder filling 308, of the insert member 340 on the bottom of the tube may be provided with a layer of glass facilitating a separation of the stainless steel material and the low alloy carbon steel.

The insert members 30, 40, 130, 140, 230, 240, 330, and 340 can also be pressed from powder material. For this purpose, for example powder obtained by water-atomizing soft iron or water-atomizing low-carbon steel can be used, which powder is subjected to isostatic cold pressing to the desired shape of the aforementioned insert members and subsequently to sintering. Cold isostatic pressing of the soft iron powder can take place in a plastic mould, the pressure being preferrably selected at least as high if not higher than the pressure for cold isostatic pressing which is applied to the aforementioned capsules. By subsequent hot sintering, a dense material can be obtained. Alternatively or additionally, in this case also a sealing can be obtained at the front end faces 34, 134, 234, 334 and 44, respectively, 144, 244, and 344 as well as onto the circumferential surfaces by applying an outer layer of glass thereon.

Figure 6:
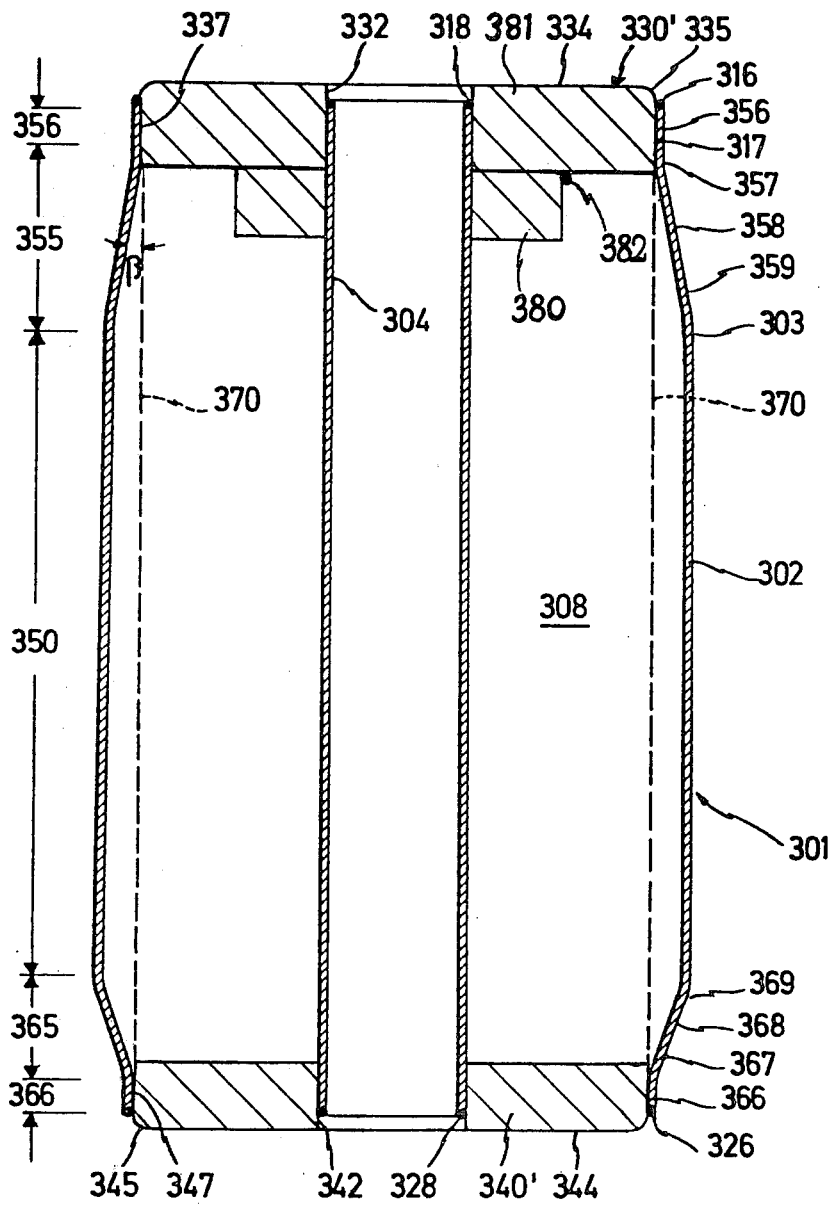

The embodiment according to FIG. 6 corresponds extensively to the embodiment according to FIG. 5. Only the insert members have a modified shape. The front insert 330' comprises two rings 380 and 381 held together by several spot weldings 382. Instead of two rings 380, 381, of course three or more rings can also be provided, whereby the outer contour of such rings constitute an approximation to the ideal contour of the front insert member which is determined by the curve 336 in FIG. 5 and the arcuate cross-section 236 in FIG. 4, and 136 in FIG. 3, respectively. In the embodiment according to FIG. 6, the insert 340' at the bottom end of the capsule consists of an annular plate. Also here, if desired, additional rings having a stepwise increasing or decreasing outer diameter and/or inner diameter can be provided in order to achieve that the insert 340' constitutes an approximation to the desired ideal profile, for example the profile 346 according to FIG. 5.

All particulars and features disclosed in the documents, particularly the spatial configuration disclosed, are claimed as being essential to the invention where they are new either individually or in combination in relation to the prior art.

We claim:

1. A capsule having an annular transverse cross section for isostatically producing a pressing for use in the extrusion of dense metallic tubes, said capsule comprising a tubular thin-walled sheet metal container to be filled with a powder and having plug-like inserts for closing each of its opposite ends, at least one of inner and outer peripheral walls of the capsule having a longitudinal profile of varying diameter by being provided with a substantially cylindrical section at each end, the diameter of which corresponds substantially exactly to the required diameter of the pressing and a bulge which is directed radially outwardly relative to a longitudinal axis of the capsule and a direction in which shrinkage will occur during isostatic pressing of the powder to form said pressing, the dimensions of said bulge being selected such that said bulge will be substantially eliminated by said shrinkage, wherein said bulge has a substantially cylindrical center section of a substantially constant diameter and conically tapering transitional regions, said central section extending substantially over the entire distance between the inserts and being connected to said substantially cylindrical end sections by said transitional regions, each of which tapers from an end of said central section to an adjacent one of said end sections.

2. A capsule as claimed in claim 1, wherein at least the one of said inserts at the front end of the capsule has a generally annular shape with a central bore for receiving the inner wall of the capsule, a substantially flat end face and a tapering outer surface.

3. A capsule as claimed in claim 2, wherein said insert is generally conical.

4. A capsule as claimed in claim 2, wherein said insert is hemispherical.

5. A capsule as claimed in claim 2, wherein said insert is funnel-shaped.

6. A capsule as in claim 2 or 3 or 4 or 5, wherein said insert is fabricated in one piece from solid material.

7. A capsule as in claim 2 or 3 or 4 or 5, wherein said insert is fabricated in one piece from pressed powder.

8. A capsule as claimed in claim 1 or 2 or 4 or 5, wherein said outer peripheral wall is fabricated of low-carbon steel.

9. A capsule as claimed in claim 8, wherein said steel has a carbon content of less than 0.015%.

10. A capsule as claimed in claim 8, wherein said steel has a carbon content of less than 0.004%.

11. A capsule as claimed in claim 2, characterised in that said inserts are in the form of covers closing the capsule at its ends and are provided at least towards the interior of the capsule with an intermediate layer of glass.

12. A capsule as claimed in claim 11, characterised in that the inserts are welded to the outer wall and inner wall.

13. A capsule as claimed in claim 11 characterised in that sheet-metal insert layers in the form of covers are arranged between the inserts and the interior of the capsule.

14. A capsule as claimed in claim 11, characterised in that the inserts consist of an electrically conductive metal.

15. A capsule as claimed in claim 14, wherein said conductive metal is soft iron.

16. A capsule as claimed in claim 5, characterised in that said funnel-shaped insert is provided only at the front end of the capsule, an angle between a wall defining the central bore and a conical outer surface of the funnel-shaped insert being between 40° and 60°.

17. A capsule as claimed in claim 16, wherein said angle is 44°.

18. A capsule as claimed in claim 11, characterised in that said annular insert provided with a central bore is provided with a substantially flat end face at the front end of the capsule and a boundary surface of substantially arcuate cross section between a wall defining the central bore and its largest external diameter, a center point of the arcuate profile lying substantially in a region of a circular intersecting line between the flat end face and the central bore.

19. A capsule as claimed in claim 1, characterised in that, at the ends of the capsule, the wall provided with the bulge has substantially cylindrical sections, of which the diameter corresponds substantially exactly, preferably to around ±0.1% or ±0.2 mm, to the required diameter of the pressing and in that the bulge opens tangentially into these cylindrical sections.

20. A capsule according to claim 19, wherein said diameter of the cylindrical sections corresponds ±0.1 mm to that required of the pressing.

21. A pressing for the extrusion of tubes, comprising a tubular capsule formed of a tubular thin-walled sheet metal container having inner and outer peripheral walls, preferably low-carbon sheet-steel having a carbon content of less than 0.015% and preferably less than 0.004%, the capsule being filled with powder from the group consisting of metal or metal alloys or mixtures thereof or mixtures thereof with ceramic powders, which preferably consists of spherical or predominantly spherical inert gas atomized particles, and the density of the powder introduced into the capsule having been increased to at least 80 to 93% of the theoretical density as a result of shrinkage produced by isostatic cold pressing of said capsule in a manner substantially eliminating a bulge, provided in at least one of said peripheral walls, that is directed outwardly relative to a longitudinal axis of the capsule and the direction of said shrinkage and which has a substantially cylindrical central section of a substantially constant diameter and conically tapering transitional regions, said central section extending substantially over the entire distance between the inserts and being connected to said substantially cylindrical end sections by said transitional regions, each of which tapers from an end of said central section to an adjacent one of substantially cylindrical end sections of the capsule, and wherein said capsule is closed at each of opposite ends by an annular plug-like insert of solid material with a central bore receiving said inner peripheral wall.

22. A pressing according to claim 21, wherein the insert at at least one of the ends of the capsule is conical.

23. A pressing according to claim 21, wherein the insert at at least one of the ends of the capsule is hemispherical.

24. A pressing according to claim 21, wherein the insert at at least one of the ends of the capsule is funnel-shaped.

25. A pressing as claimed in claim 21 or 22 or 23, characterised in that each insert is in the form of a cover closing the capsule at its end and is provided, at least towards the powder filling, with an intermediate layer of glass.

26. A pressing as claimed in claim 25, characterised in that the inserts are welded to the outer wall and inner wall.

27. A pressing as claimed in claim 21 or 22 or 23, characterised in that sheet-metal insert layers in the form of covers are arranged between the inserts and the interior of the capsule.

28. A pressing as claimed in claim 21 or 22 or 23, characterised in that the inserts consist of an electrically conductive metal, preferably soft iron.

29. A pressing as claimed in claim 24 characterised in that said funnel-shaped insert is at the front end of the capsule, an angle between the wall of the central bore for the inner wall of the capsule and the conical outer surface of the funnel-shaped insert being between 40° and 60°.

30. A pressing according to claim 28, wherein said angle is 45°.

31. A pressing as claimed in claim 21, characterised in that said annular insert is provided at least at the front end of the capsule, has a substantially flat end face and a boundary surface of substantially arcuate cross-section between the wall of the central bore and its largest external diameter, a center point of the arcuate profile preferably lying substantially in a region of the circular intersecting line between the flat end face and the central bore.

32. A process for forming a capsule for producing a pressing for use in extrusion of a dense metallic tube, said process comprising the steps of providing a tubular, thin-walled, sheet metal container, said container having an outer and inner peripheral wall; reducing the diameter of opposite end portions of at least the outer peripheral wall, so that said end portions are substantially cylindrical and correspond to the required diameter of the pressing and intermediate those end portions said wall defines a bulge which is directed outwards with respect to a longitudinal axis of the capsule and against the direction of shrinkage which will occur during subsequent isostatic pressing and which has a substantially cylindrical central section of a substantially constant diameter and conically tapering transitional regions, said central section extending substantially over the entire distance between the inserts and being connected to said substantially cylindrical end portions by said transitional regions, each of which tapers from an end of said central section to an adjacent one of said substantially cylindrical end portions of the capsule, the dimensions of said bulge being selected such that it will be substantially eliminated by such shrinkage, and providing plug-like inserts for closing the opposite ends of said container.

33. A process as claimed in claim 32, wherein the insert provided at at least a forward end of said container is of a ductile material which has a yield point lower than the yield point of the compacted powder filling within the pressing.

34. A process for producing a dense metallic tube; said process comprising:

the steps of providing a tubular, thin-walled, sheet metal container, said container having an outer and inner peripheral wall; reducing the diameter of opposite end portions of at least the outer peripheral wall, so that said end portions are substantially cylindrical and correspond to the required diameter of the pressing and intermediate those end portions said wall defines a bulge which is directed outwards with respect to a longitudinal axis of the capsule and against the direction of shrinkage which will occur during subsequent isostatic pressing and which has a substantially cylindrical central section of a substantially constant diameter and conically tapering transitional regions, said central section extending substantially over the entire distance between the inserts and being connected to said substantially cylindrical end portions by said transitional regions, each of which tapers from an end of said central section to an adjacent one of said substantially cylindrical end portions of the capsule, the dimensions of said bulge being selected such that it will be substantially eliminated by such shrinkage, providing plug-like inserts for closing the opposite ends of said container, and filling said capsule with a powder selected from the group consisting of metal or metal alloys or mixtures thereof with ceramic powders;

increasing the density of said powder by vibration to between 60 and 71% of the theoretical density;

sealing said inserts to the opposite ends of said container and further increasing the density of said powder to at least 80 to 93% of the theoretical density by isostatic cold pressing under a pressure of at least 4000 bars to produce a pressing; and extruding said pressing in an extrusion means to form said dense metallic tube.

35. A process as claimed in claim 34 wherein at least the insert provided at a forward end of said container is of a ductile material which has a yield point lower than the yield point of the compacted powder filling within the pressing.

* * * * *